US010799754B2

(12) United States Patent
Duffy

(10) Patent No.: US 10,799,754 B2
(45) Date of Patent: Oct. 13, 2020

(54) EXERCISE WEDGE AND METHOD OF USE

(71) Applicant: James Duffy, Bedford, NY (US)

(72) Inventor: James Duffy, Bedford, NY (US)

( * ) Notice: Subject to any disclaimer, the term of this patent is extended or adjusted under 35 U.S.C. 154(b) by 40 days.

(21) Appl. No.: 16/382,289

(22) Filed: Apr. 12, 2019

(65) Prior Publication Data

US 2019/0290955 A1 Sep. 26, 2019

Related U.S. Application Data

(63) Continuation-in-part of application No. 15/936,232, filed on Mar. 26, 2018, now Pat. No. 10,258,819, which is a continuation-in-part of application No. 15/274,824, filed on Sep. 23, 2016, now Pat. No. 9,925,410.

(51) Int. Cl.

| | |
|---|---|
| ***A63B 21/00*** | (2006.01) |
| ***A63B 21/04*** | (2006.01) |
| ***A63B 21/055*** | (2006.01) |
| ***A63B 23/04*** | (2006.01) |
| ***A63B 23/035*** | (2006.01) |
| ***A63B 23/12*** | (2006.01) |

(52) U.S. Cl.

CPC ..... *A63B 21/4033* (2015.10); *A63B 21/0414* (2013.01); *A63B 21/0442* (2013.01); *A63B 21/055* (2013.01); *A63B 21/4034* (2015.10); *A63B 21/4035* (2015.10); *A63B 23/03508* (2013.01); *A63B 23/03525* (2013.01); *A63B 23/03558* (2013.01); *A63B 23/0405* (2013.01); *A63B 23/1209* (2013.01)

(58) Field of Classification Search

CPC ..... A63B 21/4035; A63B 21/4034; A63B 21/0442; A63B 21/1068; A63B 23/0405; A63B 21/0628; A63B 21/00061; A63B 21/0552; A63B 21/03525; A63B 23/03575; A63B 23/1209; A63B 23/0205; A63B 23/0211; A63B 21/151; A63B 21/4015; A63B 23/03508; A63B 2023/0441; A63B 2210/50; A63B 23/03525; A63B 23/0458; A63B 2225/09; A63B 21/4033; A63B 21/0414; A63B 21/055; A63B 23/03558

USPC ..... 482/121, 130

See application file for complete search history.

(56) References Cited

U.S. PATENT DOCUMENTS 1,538,844 A * 5/1925 Titus ..... A63B 21/0004 482/139

1,980,861 A 11/1934 Hunter 4,940,226 A * 7/1990 Carra ..... A63B 69/0022 434/253

(Continued)

*Primary Examiner* — Andrew S Lo

(74) *Attorney, Agent, or Firm* — Michael J. Brown

(57) ABSTRACT

A portable exercise device designed to efficiently and safely exercise the gluteal, hamstring and calf muscles. The exercise device is an inclined platform with an elongated resistance band attached to both sides of the upper surface of the inclined platform, providing resistance from the sides of the platform. An additional raised support is provided on the inclined platform, as well as resistance originating from within the platform, which optimizes the concentric and eccentric phase of every squat and lunge for maximal strength and hypertrophy of the muscles. The combination of the inclined platform with resistance from the sides and from the platform itself allows the user to conduct a variety of exercises for strengthening the muscles of the lower body.

10 Claims, 5 Drawing Sheets

(56) References Cited

U.S. PATENT DOCUMENTS 5,127,892 A * 7/1992 Sawdon ..... A63B 22/20 482/79
5,326,338 A * 7/1994 Makous ..... A63B 69/0022 434/253
5,352,176 A * 10/1994 Huang ..... A63B 21/0004 482/123
5,524,893 A 6/1996 McGinnis et al.
5,813,954 A * 9/1998 Wilkinson ..... A63B 21/0004 482/124
6,042,523 A * 3/2000 Graham ..... A63B 21/0552 482/121
7,410,450 B1 * 8/2008 Paulding ..... A63B 21/0552 482/120
7,431,681 B1 * 10/2008 St. Cyr ..... A63B 21/0552 482/121
8,062,189 B1 11/2011 Moring, Jr. et al.
8,444,532 B1 * 5/2013 Barcena ..... A63B 21/4035 482/51
9,649,522 B2 * 5/2017 Wyatt ..... A63B 21/4015
2006/0046911 A1 * 3/2006 Leight ..... A63B 21/151 482/91
2006/0128539 A1 * 6/2006 Marquez ..... A63B 21/4043 482/123
2006/0128540 A1 * 6/2006 Engle ..... A63B 21/04 482/123
2007/0129226 A1 * 6/2007 Leavitt ..... A63B 23/0458 482/129
2009/0192022 A1 * 7/2009 Kulka ..... A63B 23/0355 482/46
2009/0192028 A1 * 7/2009 Shank ..... A63B 26/00 482/148
2009/0275449 A1 * 11/2009 Terry ..... A63B 23/03525 482/139
2010/0255966 A1 * 10/2010 Aucamp ..... A63B 21/0552 482/131
2011/0124473 A1 * 5/2011 Kole ..... A63B 23/10 482/79
2011/0251033 A1 * 10/2011 Blancher ..... A63B 22/16 482/123
2012/0115692 A1 * 5/2012 Bussen ..... A63B 21/0442 482/130
2012/0184412 A1 * 7/2012 Glaner ..... A63B 69/18 482/30
2012/0316042 A1 * 12/2012 Carlson ..... A63B 23/0211 482/140
2013/0079202 A1 * 3/2013 Librizzi ..... A63B 21/0428 482/129
2013/0090216 A1 * 4/2013 Jackson ..... A63B 21/154 482/52
2014/0128230 A1 * 5/2014 Burcham ..... A63B 21/0552 482/123
2014/0256525 A1 * 9/2014 Mueller ..... A61H 1/0292 482/142
2015/0182775 A1 * 7/2015 Toback ..... A63B 5/16 482/130
2016/0193490 A1 * 7/2016 Chen ..... A63B 21/4035 482/126
2017/0232302 A1 * 8/2017 Dedvukaj ..... A63B 22/16 482/123
2017/0291055 A1 * 10/2017 Madion ..... A63B 21/4039
2017/0333744 A1 * 11/2017 Chapman ..... A63B 21/0442
2018/0178058 A1 6/2018 Fano et al.
2018/0271735 A1 * 9/2018 Drucker ..... A63B 23/0458

* cited by examiner

EXERCISE WEDGE AND METHOD OF USE

PRIORITY

This application is a continuation in part of U.S. patent application Ser. No. 15/936,232 filed Mar. 26, 2018, which is a continuation in part of U.S. patent application Ser. No. 15/274,824 filed Sep. 23, 2016 (issued as U.S. Pat. No. 9,925,410 on Mar. 27, 2018), the contents of which are incorporated by reference.

FIELD OF INVENTION

The invention is in the field of exercise equipment, specifically portable exercise equipment that can be used at home or at a gym.

BACKGROUND

Exercising the gluteal and hamstring muscles correctly and efficiently is difficult and may put strain on the exerciser's knees and back, causing injuries. It is also difficult, if not impossible, to target these muscles without also working out the front of the thighs, which many people do not want to do.

Squats and lunges are two main exercises prescribed to best work out and develop the gluteal and hamstring muscles. Many people cannot perform squats or lunges because of back and knee issues. Squats and lunges are difficult exercises and without proper supervision can cause great harm to knees and backs, especially when using free weights. Proper form is difficult but essential to performing squats and lunges safe and effectively. When doing squats even when supervised it is difficult to keep your body in the proper position and form to be safe and effective. Further, these exercises will always build up quadricep muscles equally with the gluteal and hamstring muscles, if not more at the same time. Many women in particular prefer not to over build their quadriceps but still want to work on their gluteal and hamstring muscles.

When doing squats and lunges, many people let their knees extend forward beyond their toes, which is dangerous for the knees. Professional trainers often provide two points of advice: (a) keep your weight on your heels and (b) don't extend your knees past your toes. People often perform squats and lunges with bar bells or free weights to add more resistance than just their body weight. If not done right the exercises can cause harm to your knees and back.

It is also desirable to have an exercise device that provides the user with the ability to perform different type of exercises, such as core strengthening exercises and leg strengthening exercises.

There is no portable exercise device with built in resistance that is safe and effective, and targeting and isolating the gluteal, hamstring and calf muscles, while removing much of the stress from the knees and back.

SUMMARY OF THE INVENTION

The present invention is a portable exercise device designed to efficiently and safely target and isolate the gluteal, hamstring and calf muscles, which are the posterior muscles of the lower body, while limiting the use and over training of the quadriceps (thigh) anterior muscles of the lower body. The invention is comprised of an inclined platform with an additional inclined support on its surface, the platform providing resistance extending from within the platform, in front of the user and centrally located with respect to the user's body. This resistance optimizes and enhances the concentric and eccentric phases of the exercise. The double incline design puts the user's body into an optimal position so more of the resistance for each exercise is exerted on the posterior side of the lower body. This double inclined platform with built in resistance is unique because it places the individual exerciser in the optimal position and form that makes each squat and lunge safer and more effective to shape, lift and firm the gluteal muscles while limiting the use of the quadricep muscles. It does this without putting the stresses on the knees and back that are usually associated with performing squats and lunges.

The double wedge design and utility puts the user's body in the optimal position to do squats and lunges to obtain optimal muscle exhaustion and build on the posterior side of the leg, targeting the hamstring and gluteal muscles, while putting less stress and exhaustion on the quadricep muscles which are on the anterior side of the leg.

An additional feature of the invention provides resistance connected to the surface of the platform, along the sides of the platform, which resistance allows for exercises such as kick backs, kick ups, side step squats, and gluteal bridges. For a kickback, the user would place their hands or forearms on the inclined platform, and push against the side resistance in a direction away from the inclined platform. For a gluteal bridge or an abdominal thrust, the user would lie on the ground, with their feet on the inclined platform, and with the side resistance placed across their abdomen, the user would push upward from the floor, against the resistance provided by the side resistance.

DETAILED DESCRIPTION OF THE PREFERRED EMBODIMENT

Figure 1:
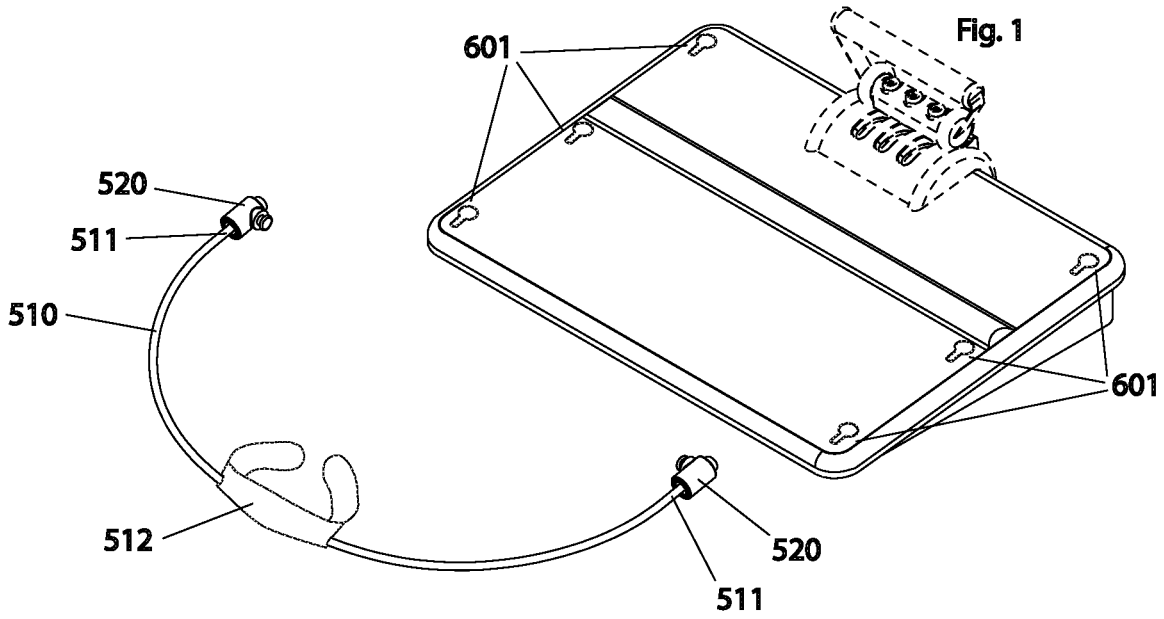
FIG. 1 is a top perspective view of the preferred embodiment of the present invention, showing the connectors separated from the base wedge.

The invention preferably consists of a wedge shaped base 100, with front edge 101, rear panel 102, and sides 104. Base 100 is preferably in the shape of an inclined plane, with an inclined upper surface 110 relative to a flat bottom.

Upper surface 110 is formed between front edge 101, rear panel 102 and sides 104. Bottom 120 of base 100 is preferably open, at least partially, as is discussed below. The height of front edge 101 is shorter than the height of rear panel 102, resulting in upper surface 110 forming an inclined surface extending upward vertically from front edge 101 to the top of rear panel 102. The angle formed between inclined upper surface 110 and bottom 120 is preferably between 5 and 25 degrees.

Figure 2:
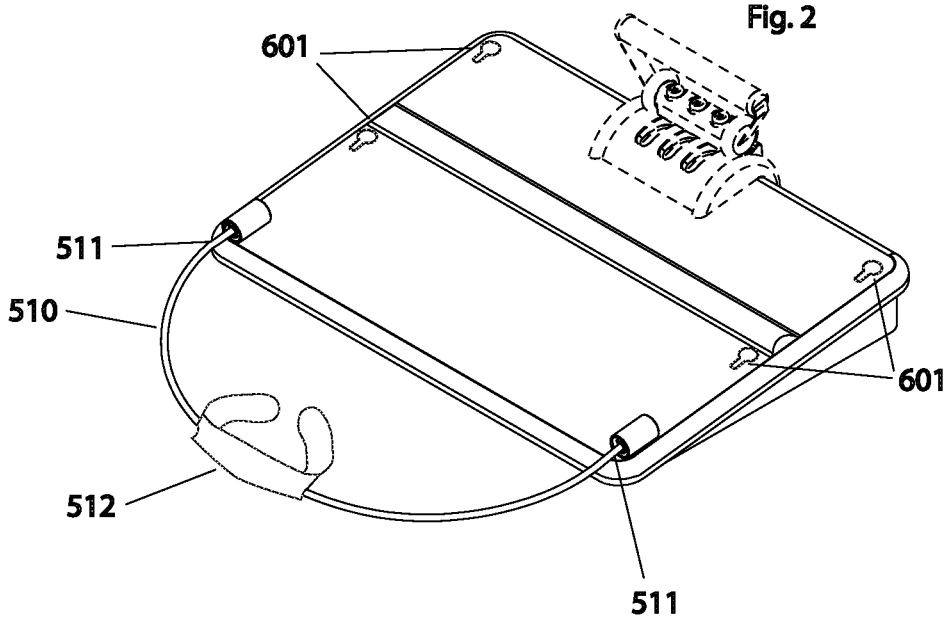
FIG. 2 is another top perspective view thereof, showing the connectors engaged with the base wedge.
Figure 3:
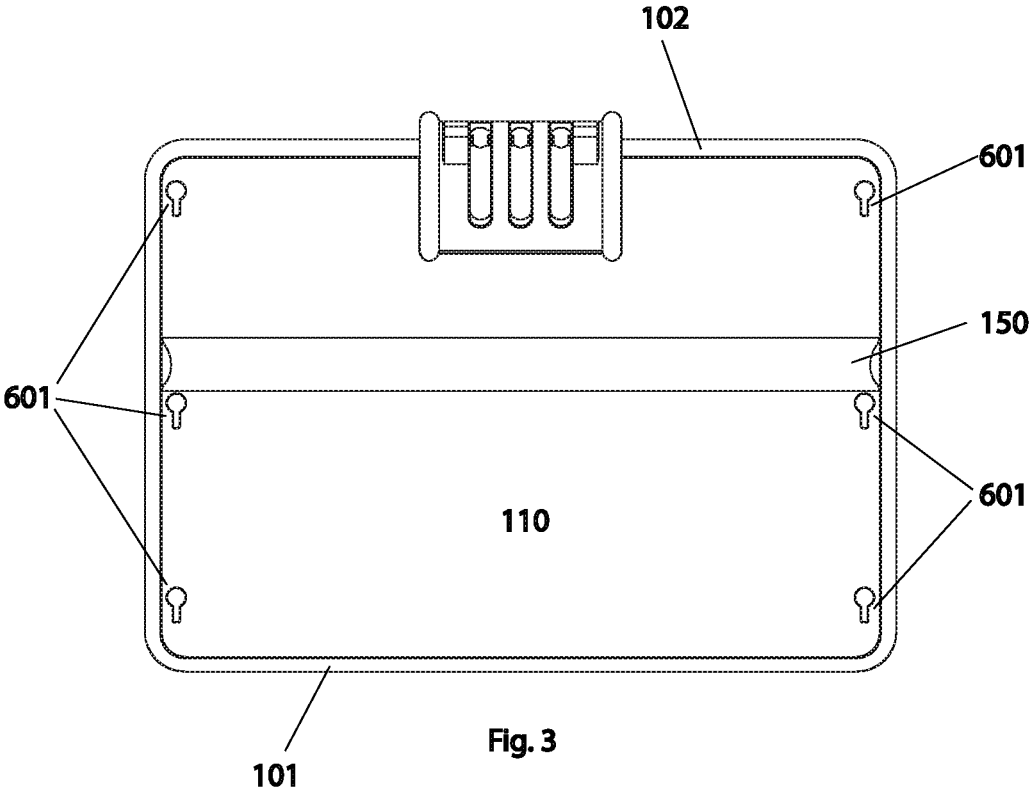
FIG. 3 is a top plan view of the base of the invention.
Figure 4:
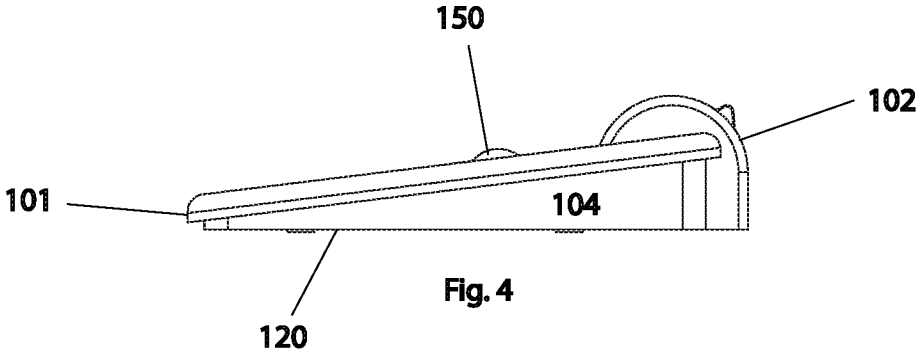
FIG. 4 is right elevational view thereof, the left elevational view being a mirror image.
Figure 5:
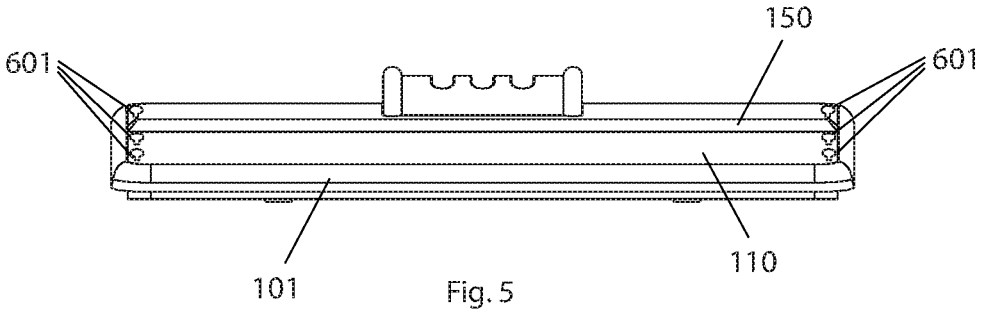
FIG. 5 is a front elevational view thereof.
Figure 6:
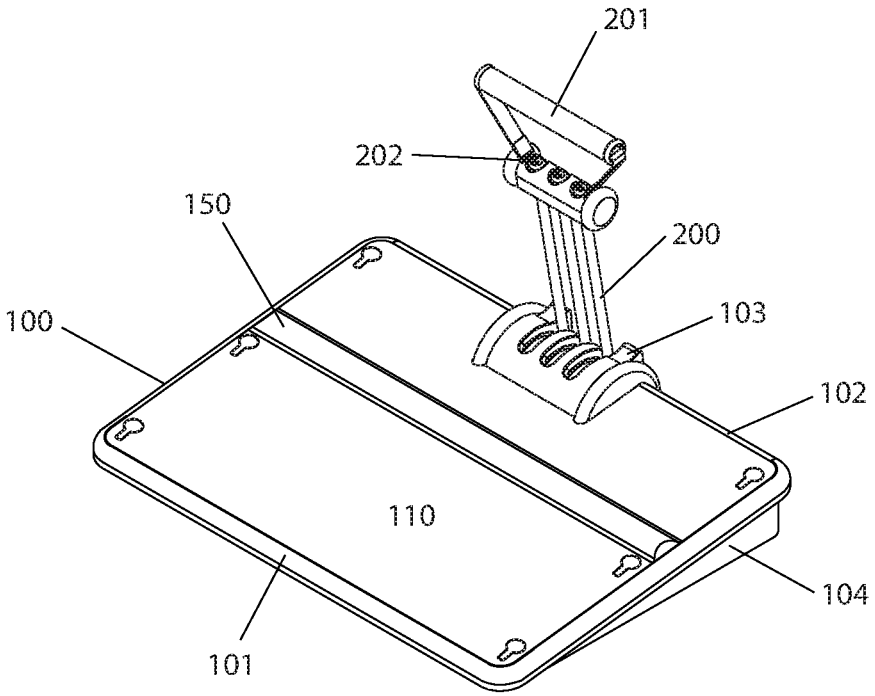
FIG. 6 is another top perspective view thereof, showing the center handle and resistance cord.

A connection point 601 is provided on upper surface 110, near each of sides 104. Each of the connection points 601 is preferably located at the same distance from front edge 101, so that a pair of connection points 601 are in a roughly parallel arrangement. In a preferred embodiment, a plurality of connection points 601 are located on upper surface 110, near each of sides 104, as shown in FIGS. 1 and 2.

Elongated side resistance cord 510 with ends 511, has a connector 520 located at each end 511. Connector 520 engages connection point 601, allowing a user to apply force against the resistance of elongated side resistance cord 510. Connector 520 engaged into connection point 601 preferably does not move with the application of force by the user, but may be engaged or disengaged by the user as desired.

Elongated side resistance cord 510 preferably comprises at least one strap 512 for attachment to a user's foot or ankle for use during exercises, which may further comprise a buckle or other fastener.

In another embodiment, cushion 550 may be provided on elongated side resistance cord 510. Cushion 550 is preferably a hollow cylinder, where elongated side resistance cord 510 may be threaded through a hollow opening of the cushion. In an alternate embodiment, cushion 550 may have a slot along its length, allowing elongated side resistance cord 510 to be inserted lengthwise into the cushion. Cushion 550 is preferably padded to provide a relatively larger surface area across a user's abdomen for use during certain exercises and to disperse the pressure of the elongated side resistance cord 510.

Opening 103 is located within the plane of upper surface 110, proximate to rear edge 102, and is preferably located equidistant from sides 104. In an alternate embodiment, a plurality of openings 103 may be provided. Opening 103 provides a point of origin for resistance for the user's exercises.

Elongated wedge 150 is located on surface 110, providing an elongated raised support on surface 110, extending between sides 104. Elongated wedge 150 preferably extends vertically from surface 110 between ¼ of an inch to 1½ inches. Elongated wedge 150 is located between front edge 101 and opening 103, and extends between sides 104, approximately parallel to front edge 101. Elongated wedge 150 may be fixed in location, but is preferably capable of being adjusted into a location between front edge 101 and opening 103. Where elongated wedge 150 is capable of movement, it is preferred to maintain a parallel relationship between elongated wedge 150 and front edge 101. Elongated wedge 150 is preferably placed so that the toes or balls of a user's feet may be placed upon elongated wedge 150 to provide additional lift and angle of the user's feet during use of the invention.

Elongated resistance member 200 extends through opening 103. Handle 201 is attached to handle end 202 of elongated resistance member 200. In a preferred embodiment, base end 203 of elongated resistance member 200 is attached to base 100. Elongated resistance member 200 is preferably elastic, providing resistance to extension or pulling. Elongated resistance member 200 may be comprised of rubber or springs. In a preferred embodiment, elongated resistance member 200 may be comprised of a variety of interchangeable rubber or elastic cords of varying resistance, allowing the user to vary or change the resistance.

Handle 201 may be configured in a variety of forms, including a bar for use with one or two hands, a strap, or other types of handles as are known for use with exercise equipment. Where more than one elongated resistance member 200 is used, each elongated resistance member 200 may be connected to a separate handle 201, or they may be connected to a single handle 201, as is shown in FIG. 1.

Bottom 120 of base 100 is preferably open, allowing the user access to elongated resistance member 200. In the preferred embodiment, base end 203 of elongated resistance member 200 is removably attached to base 100 proximate to front edge 101, where the user may swap or interchange different elongated resistance members 200 to allow for variation in the exertion needed for a given exercise. It is well known in the art to provide elastic resistance bands and straps of varying resistance for exercise. One embodiment of the present invention provides a notch and tab engagement of base end 203 and base 100, where base end 203 may slide into a notch located in base 100.

Figure 7:
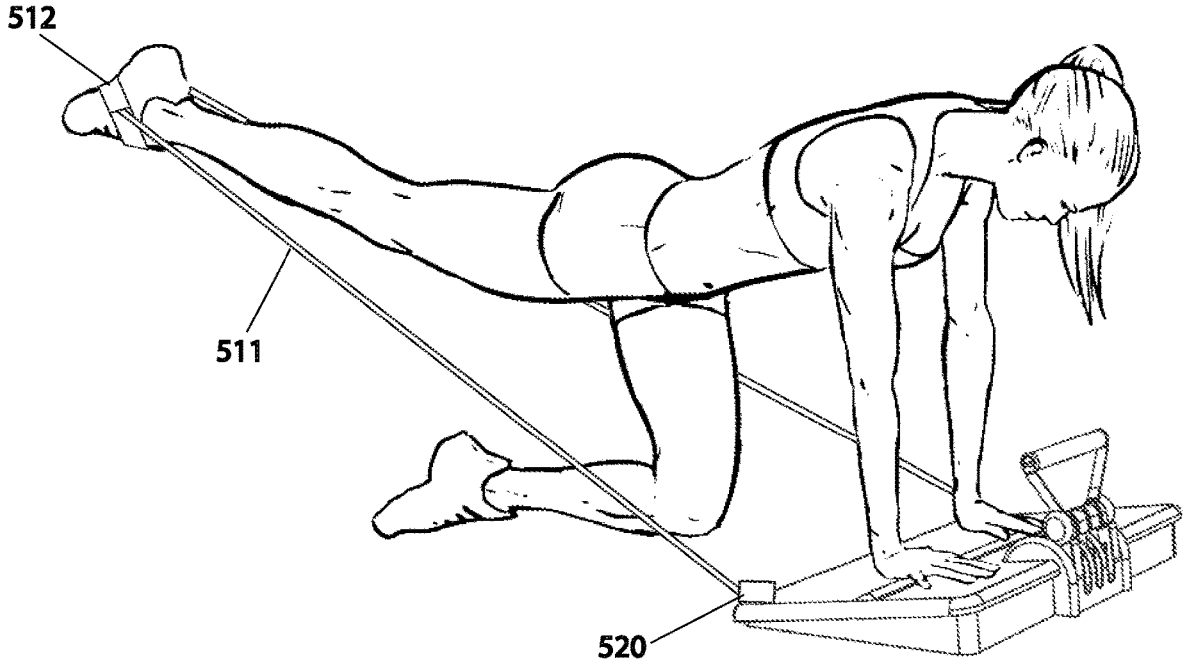
FIG. 7 is a side perspective view, showing use of the invention for a kick back exercise.

The invention may be used for different exercises to strengthen leg muscles, include kick back, donkey kick, and gluteal bridge. As shown in FIG. 7, for kick back and donkey kick exercises, the user would place at least one arm or hand on the inclined surface, and, with the elongated side resistance cord 510 attached to the left and right sides of the 104, the user would place their foot against the side resistance cord 510, or attach strap 512 to the foot. The user would then push their foot away from the base, parallel to the floor for a kick back or upward for a donkey kick.

Figure 8:
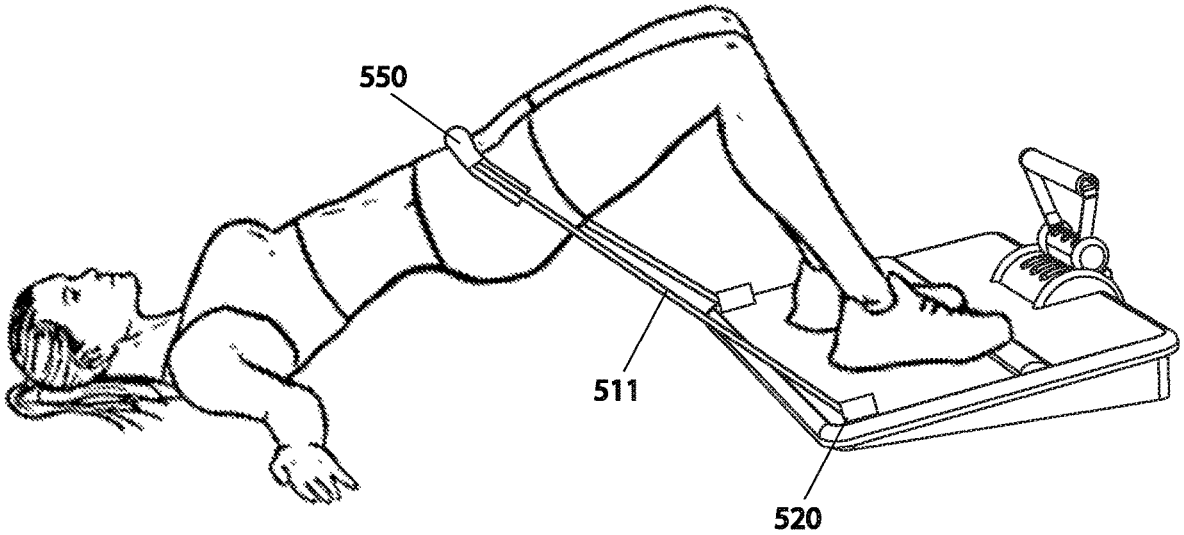
FIG. 8 is a side perspective view, showing use of the invention for a glute bridge exercise.

As shown in FIG. 8, for a gluteal bridge, the user would lie on the floor, with their feet on the inclined surface, and their buttocks on or near front edge 101. With elongated side resistance cord 510 attached to the left and right sides of upper surface 110, the user would place a length of elongated side resistance cord 510 across their abdomen. Cushion 550 is preferably provided on elongated side resistance cord 510 for the user's comfort. The user would then raise their buttocks upward, against the resistance of elongated side resistance cord 510.

While certain novel features of the present invention have been shown and described, it will be understood that various omissions, substitutions and changes in the forms and details of the device illustrated and in its operation can be made by those skilled in the art without departing from the spirit of the invention.

I claim:

1. An exercise device comprising:

a base with a front edge, rear panel, a left side panel, and a right side panel, where the rear panel has an upper edge and a lower edge, the upper and lower edges of the rear panel extending between the left and right side panels of the base, and where the distance between the upper and lower edges creates a height of the rear panel, and where a plane is formed between the front edge, the upper edge of the rear panel and the left and right side panels, the plane being an inclined surface extending in an upward direction from the front edge to the upper edge of the rear panel;

a first connection point on the plane proximate to the left side panel;

a second connection point on the plane proximate to the right side panel, where the first and second connection points are located at the same distance on their respective side panels from the front edge;

a first elongated resistance member, the first elongated resistance member having first and second connector ends, the first connector end removably attached to the first connection point;

the second connector end removably attached to the second connection point; and a strap moveably located on the first elongated resistance member.

2. The exercise device of claim 1, further comprising:

a plurality of connection points on the plane proximate to at least one of the left side panel or the right side panel.

3. The exercise device of claim 1, where the first elongated resistance member is comprised of an elastic material.

4. The exercise device of claim 1, further comprising:

an opening in the inclined surface, the opening located proximate to the rear panel; and a second elongated resistance member, the second elongated resistance member having a handle end and a base end, the handle end extending through the opening.

5. The exercise device of claim 4, further comprising:

a raised elongated wedge on the inclined surface, the raised elongated wedge having two ends, each of the ends oriented toward one of the left and right side panels, where the raised elongated wedge provides a surface extending away from the inclined surface.

6. The exercise device of claim 5, where the raised elongated wedge is capable of movement along the inclined surface.

7. A method of exercising leg muscles comprising:

providing a floor wedge with an inclined surface, a left side panel, a right side panel, and a front edge of the inclined surface, the floor wedge placed on a floor;

providing a first elongated resistance member with a left connector end and a right connector end, the left connector end attached at a left connection point on the inclined surface proximate to the left side panel, the right connector end attached at a right connection point on the inclined surface proximate to the right side panel, and the first elongated resistance member having a resistance to movement away from the left and right connection points;

placing a user's feet on the inclined surface, where the user's back is on the floor;

placing the first elongated resistance member across the user's torso; and having the user apply force to the first elongated resistance member in a direction away from the left and right connection points.

8. The method of claim 7, where the first elongated resistance member is elastic.

9. A method of exercising leg muscles comprising:

providing a floor wedge with an inclined surface, the inclined surface having a left side edge and a right side edge, and a front edge of the inclined surface, the floor wedge placed on a floor;

providing a first elongated resistance member with a left connector end and a right connector end, the left connector end attached at a left connection point on the inclined surface proximate to the left side edge, the right connector end attached at a right connection point on the inclined surface proximate to the right side edge, and the first elongated resistance member having a resistance to movement away from the left and right connection points; and placing at least one of a user's hand or arm on the inclined surface, where the user is on his or her knees on the floor;

having the user place at least one foot against the first elongated resistance member; and having the user apply force with the one foot against the first elongated resistance member in a direction away from the left and right connection points.

10. The method of claim 9, where the first elongated resistance member is elastic.

* * * * *